United States Patent [19]

Froehlich et al.

[11] B 4,013,594

[45] Mar. 22, 1977

[54] POWDERED CLEANING COMPOSITION OF UREA-FORMALDEHYDE

[75] Inventors: Helmut Hermann Froehlich; William Jacob Lautenberger, both of Wilmington, Del.

[73] Assignee: E. I. Du Pont de Nemours and Co., Wilmington, Del.

[22] Filed: Jan. 16, 1974

[21] Appl. No.: 433,707

[44] Published under the second Trial Voluntary Protest Program on March 23, 1976 as document No. B 433,707.

Related U.S. Application Data

[63] Continuation-in-part of Ser. No. 394,263, Oct. 8, 1973, abandoned, which is a continuation of Ser. No. 209,402, Dec. 17, 1971, abandoned.

[30] Foreign Application Priority Data

| | | |
|---|---|---|
| Dec. 15, 1972 | France | 72.44806 |
| Dec. 15, 1972 | Germany | 2261587 |
| Dec. 16, 1972 | Japan | 47-125837 |
| Dec. 15, 1972 | United Kingdom | 58090/72 |

[52] U.S. Cl. ..... 252/544; 252/88; 252/153; 252/DIG. 2

[51] Int. Cl.[2] ..... C11D 1/38; C11D 1/50; C11D 3/26

[58] Field of Search ..... 252/88, 91, 545, 172, 252/DIG. 2, 544, 153

[56] References Cited

UNITED STATES PATENTS

| | | | |
|---|---|---|---|
| 2,250,379 | 7/1941 | Johnson | 252/544 X |
| 2,789,095 | 4/1957 | Lindvig | 252/DIG. 2 |
| 3,533,953 | 10/1970 | Mills et al. | 252/88 |

FOREIGN PATENTS OR APPLICATIONS

| | | |
|---|---|---|
| 2,015,972 | 4/1970 | France |

*Primary Examiner*—Thomas J. Herbert, Jr.

[57] ABSTRACT

A powdered cleaning composition particularly effective in removing soil from carpets comprising solid polymeric urea-formaldehyde particles of 10 to 105 microns in size and a solvent chosen from water, high boiling hydrocarbon or chlorinated hydrocarbon solvents, $C_1$ to $C_4$ aliphatic alcohols and mixtures of these.

5 Claims, No Drawings

POWDERED CLEANING COMPOSITION OF UREA-FORMALDEHYDE

CROSS-REFERENCE TO RELATED APPLICATIONS

This is a continuation-in-part of copending application Serial Number 394,263, filed October 8, 1973, now abandoned, which is a continuation of application Serial Number 209,402, filed December 17, 1971, and now abandoned.

BACKGROUND OF THE INVENTION

The use of dry materials for cleaning carpets and other textiles has become widespread in recent years. The word "dry" as used in this regard means that the composition will flow and can be handled as a powder, though it may contain considerable amounts of a liquid such as water and organic solvents.

A variety of solid materials have been used for such compositions, including polyurethane, polystyrene and phenol-formaldehyde resin particles as in French Pat. No. 2,015,972. The particles are generally combined with some water, an organic liquid and a surfactant. The resulting composition is distributed into the carpet and, after an interval, is removed with a vacuum cleaner. While a number of specific materials have been recommended for use as solid particles, previous compositions of this type have been limited in their effectiveness in removing soil. Moreover, some dry compositions, such as those based on diatomaceous earth, tended to cling to the carpet and even damage the fibers.

SUMMARY OF THE INVENTION

This invention provides cleaning compositions having high soil removal capacity, which avoid damage to the carpet fibers during cleaning, and which are quick-acting, requiring only a very short interval between application of the cleaning composition to the carpet and removal therefrom.

Specifically, the present invention provides a powdered cleaning composition having a soil substantivity constant greater than 1.5 and consisting essentially of about 30 to 90% particulate polymeric urea-formaldehyde and about 10 to 70% fluid, the urea-formaldehyde having a particle size of about from 10 and 105 microns, an oil absorption value of no less than 90, fiber hardness, and a bulk density of at least 0.2 g./cc., and the fluid consisting essentially of up to 100% water containing sufficient surfactant to give a surface tension of less than 40 dynes per centimeter and up to 100% of organic liquid selected from high boiling hydrocarbon solvents, tetrachloroethylene, methyl chloroform, 1,1,2-trichloro-1,2,2-trifluoroethane, an aliphatic alcohol containing from 1 to 4 carbon atoms, and mixtures of these.

DESCRIPTION OF THE INVENTION

The compositions of the invention use particles of a carefully defined size, porosity, and bulk density, and have an affinity for the soil constituents normally found in American cities and homes.

Methods have been developed for economically putting the urea-formaldehyde polymers into satisfactory physical form for use in the cleaning compositions of this invention. Ordinarily the mere grinding of a foamed material to a preferred size does not produce a satisfactory product. Such comminuted materials ordinarily do not have sufficient bulk density to function satisfactorily. Existing techniques of polymerization and insolubilization enable the synthesis of satisfactory particles which are sufficiently porous to provide an oil absorption value of greater than 90. For example, urea and formaldehyde can be polymerized in an acidic aqueous mixture, preferably containing surfactant. A particularly satisfactory technique is that described in U.S. Pat. No. 2,766,283 to Warden, except that a urea/formaldehyde ratio of about 0.91/1.0 is used and the pH of the reaction is maintained at about 1.8.

Porosity for the purposes of this invention is measured by an oil value as determined according to Method D281 of the American Society for Testing Materials.

In order to function satisfactorily the particles for use in the cleaning compositions of this invention must exhibit an oil value of at least 90. Lower porosity particles do not carry sufficient cleaning fluid. Oil values over 130 are preferred.

Particle size should be between 10 and 105 microns (1500 to 140 mesh). Larger particles do not penetrate carpet material adequately, and use of such particles would result in only superficial cleaning at best. In addition, larger particles generally have insufficient surface area to adsorb a large amount of soil per unit of weight. If the particles are smaller than 10 microns in size, they adhere to the individual carpet fibers and have a delustering or dulling effect on the color of the carpet. A small proportion of undersize particles can be tolerated, up to about 2%. The most preferred range of particle sizes is between 37 and 105 microns (400 to 140 mesh).

Particles of the required particle size prepared by the techniques described above have a compact, uniform configuration, which results in a bulk density of greater than 0.2 g./cc. The bulk density is determined by conventional techniques, involving weighing a quantity of particles which fill a calibrated container without packing.

In preparing cleaning compositions of this invention, using particles having the required properties, the cleaning fluid can be water containing sufficient surfactant to lower the surface tension to below 40 dynes per centimeter, an organic liquid, or mixtures of water, surfactant and organic liquid. Organic liquids which can be used include $C_1$ to $C_4$ aliphatic alcohols, high boiling hydrocarbon solvents and high boiling chlorinated hydrocarbon solvents. The hydrocarbon solvents are generally the petroleum distillates with a boiling point between about 100°C. and about 300°C. Low boiling organic liquids are generally unsuitable from a standpoint of vapors and flammability and higher boiling organic liquids do not evaporate from the carpet fibers at a rapid enough rate. Representative of commercially available hydrocarbon solvents are Stoddard solvent and odorless hydrocarbon solvent. These solvents usually consist of a petroleum distillate boiling at about 150° to 200°C. Properties of these solvents are comparable to those of British Standard White Spirit and domestic Mineral Spirit. Chemically these solvents consist of a number of hydrocarbons, principally aliphatic, in the decane region. Representative of the high boiling chlorinated hydrocarbon solvents are perchloroethylene, methylchloroform and 1,1,2-trichloro-1,2,2-trifluoroethane. The most preferred organic liquid is a high boiling hydrocarbon solvent.

Surfactants of a number of classes are satisfactory for use in the compositions of this invention. The selection of a surfactant is not critical but the surfactant should serve to lower the surface tension of the water in the composition to 40 dynes per centimeter or lower. Preferred anionic surfactants are long chain alcohol sulfate esters such as those derived from $C_{10}$-$C_{18}$ alcohols sulfated with chlorosulfonic acid and neutralized with an alkali. Also preferred are alkylene oxide additives of $C_6$-$C_{10}$ mono and diesters of ortho-phosphoric acid. Representative nonionic surfactants that can be used have the formula $$R(O\overset{\overset{C_nH_{2n+1}}{|}}{C}H-CH_2)_mR'$$

where $n$ is 0 or 1, $m$ is 3 to 20, R' is OH or $OCH_3$, R is $C_{12}$ to $C_{22}$ alkyl or phenyl or naphthyl optionally substituted by $C_1$ to $C_{10}$ alkyl groups.

Representative cationic surfactants that can be used are quaternary compounds of the structure $[RNR_1R_2R_3]^+ X^-$ where R is $C_{12}$ to $C_{22}$ and includes the commercially important mixtures of alkyls obtained from tallow, hydrogenated tallow and cocoa. $R_1$ and $R_2$ is $CH_3$, $CH(CH_3)CH_2OH$ or $CH_2CH_2OH$. $R_3$ is $CH_3$, $C_2H_5$ or $C_6H_5CH_2$, and X is Cl, Br, I or $CH_3SO_3$.

The surfactant can be a mixture of a nonionic surfactant and either an anionic surfactant or a cationic surfactant. Mixtures of anionic and cationic surfactants are suitable only in carefully selected cases. A preferred composition contains from 1 to 4% nonionic surfactant and 1 to 4% cationic surfactant. A satisfactory mixture of commercial anionic surfactants comprises (1) 0.4% of the sodium salt of a mixture of $C_{10}$-$C_{18}$ alcohol sulfates, predominantly $C_{12}$, (2) 0.4% of the diethylcyclohexylamine salt of the same sulfate mix, and (3) 0.2% of the product formed by reacting a mixture of n-octyl mono and diesters of ortho-phosphoric acid with sufficient ethylene oxide to form a neutral product, ordinarily about 2 to 4 mols of ethylene oxide per mol of phosphoric ester. The surfactant is normally used in amounts ranging from 0.5 to 5.0% by weight but useful amounts are not limited to this range.

In a preferred embodiment of the invention, the cleaning fluid further comprises about from 2 to 10% by weight of a cationic antistatic agent, which can be the same as or different from the surfactant. It has been found that minute particles are left under low humidity conditions after substantially complete removal of the present cleaning compositions, and these tend to "dust" onto shoes. The inclusion of such an antistatic agent prevents such dusting and facilitates removal of the particles. Commercially available cationic antistatic compositions which have been found particularly effective for this use include myristye trimethyl ammonium bromide; octadecyl trimethyl ammonium chloride; and lauryl imidazolinium chloride.

The minimum proportion of particulate material in the composition is about 30%, as it is difficult to preserve the necessary "dry" character with lower proportions of solid. The fluid portion of the composition may thus form from 10 to 70% of the composition and is preferably between 25 and 50% of the total composition weight. Where the cleaning fluid is a mixture of water and solvent there is no limit on the proportions of each which can be used; a particularly effective ratio, however, is 7 parts water to 3 parts solvent.

Cleaning compositions of this invention which comprise porous particles, water and surfactant are effective for cleaning some soiled carpets, but they are less effective in cleaning carpets soiled with material of an oily nature. For the latter carpets more satisfactory cleaning is achieved by including at least some organic cleaning solvent in the composition.

In preparing the cleaning compositions of this invention, the best results are obtained by combining the porous particles with enough of the preferred cleaning fluid to almost saturate the particles. Thus it will be seen that a particle with low porosity cannot carry sufficient cleaning fluid to produce a composition having the maximum cleaning power. The precise amount of cleaning fluid used must be determined by trial and error but the oil value can serve as a guide to that amount. Particles having low oil values do not require much cleaning fluid while those of high porosity, i.e. high oil values, require more cleaning fluid. For example, particles with oil values between 90 and 130 normally require 30 to 35% cleaning fluid while particles with oil values of 200 to 300 normally require 35 to 60% cleaning fluid. Particles with oil values below 90 cannot carry sufficient cleaning fluid to do a satisfactory carpet cleaning job. The optimum amount of cleaning fluid varies depending upon the properties of the particular particle. The soil substantivity constant aids in the determination of the optimum amount of cleaning fluid that can be used with a given particle.

The mixing can take place in a customary manner using means apparent to those skilled in the art. Alternatively the mixing can take place in situ, by feeding the fluid and the polymeric particles separately to the carpet and mixing them in the carpet fibers.

Compositions of this invention exhibit an excellent soil substantivity constant. It is possible to calculate this constant because it has been discovered that the distribution of soil between the particles and the carpet is an example of a classic solid-solid equilibrium adsorption process. As in the determination of any equilibrium constant, certain conditions must be held constant. In this instance the type of soil, the amount of soil, the type and amount of carpet and the composition of the cleaning fluid are held constant. In addition the amount of cleaning fluid is such that the soil substantivity is a maximum. Sufficient agitation must be provided to assure that equilibrium is reached. The device described below has been shown to be adequate for this purpose but other agitation means can be used.

The soil substantivity constant A is defined as $$A = \frac{C_p}{C_c}$$

where $C_p$ equals the amount of soil on the particle at equilibrium and $C_c$ equals the amount of soil on the carpet at equilibrium. They are calculated from the equations $$C_p = \frac{(1-R_s)^2}{2R_s} - \frac{(1-R_c)^2}{2R_c} \text{ and } C_c = \frac{(1-R_c)^2}{2R_c}$$

where

R = reflectance as a decimal value of the reflectance of white, unsoiled carpet $R_s$ = reflectance of soiled carpet $R_c$ = reflectance of cleaned carpet.

For testing soil substantivity, a 4¾ by 5¾ inch piece of tufted, low-level loop, white, trilobal nylon carpet which has been mock dyed to remove any spinning agents is treated with soil and tested, employing a standard soiling composition as described by Florio and Mersereau in Text. Res. J. 25, 641 (1955). The composition consists of:

38% Peat Moss
17% Cement
17% Kaolin Clay
17% Silica (240 mesh)
1.75% Molacco Furnace Black
0.50% Red Iron Oxide
8.75% Mineral Oil (Nujol)

Before use, this composition is bulked by adding silica gel of 28–200 mesh. One part of soil is mixed with 29 parts of silica gel by rolling in a small drum for 30 minutes. This bulked soil is applied to carpet samples according to the accelerated soiling Method No. 123-1967T of the American Association of Textile Chemists and Colorists. In a one-gallon ball mill five 5¾ by 4¾ inch carpet pieces are fastened, then 2400 grams of ½ inch diameter flint pebbles and 30 grams of bulked soil is added. The ball mill is rolled for 30 minutes, then the carpet pieces are removed and vacuum cleaned for 150 seconds, stroking in both directions (90° angle) for 75 seconds to remove excess soil before applying the cleaning composition. To improve reproducibility of this soiling procedure the ball mill, flint pebbles, carpet and diluted soil are maintained for 24 hours at 48% relative humidity and 75°F. The starting point for the test is established by determining light reflectance with a "Photovolt" Reflection Meter, Model 610. Unsoiled, white, level-loop carpet gives a reflectance of 100 and black felt a reading of 0. After the soiled carpet has been subjected to a cleaning process involving a "dry" carpet cleaning composition, reflectance is again determined, averaging 10 readings obtained on the face side of the carpet piece. The device used in the cleaning process is a Sears and Roebuck Craftsman Orbital Sander, Model 315.22462572S operating on 110–120 volt and 1.65 ampere. An elastomeric plate bearing 16 cylindrical protuberances per square inch of about ⅛ inch in diameter and 5/16 inch in length over essentially all of its surface is connected to the plate of the sander where the sandpaper is normally placed. The device is placed on a carpet swatch containing the cleaning composition and allowed to agitate for 2 minutes under slight pressure. After 15 minutes drying time the particles and adsorbed dirt are removed with a vacuum cleaner, the reflectance determined and the soil substantivity constant is calculated.

This method gives quantitative results that have been found reasonably reproducible, and much better than mere visual estimation.

Higher soil substantivity constant indicates a better cleaning composition. For example, a cleaning composition having a maximum soil substantivity constant of 1.5 would remove 60% of the soil under the standard test conditions and one having a maximum soil substantivity constant of 5 would remove 83% of the soil.

In order to determine the optimum amount of cleaning fluid it is necessary to determine the soil substantivity constant at several different levels of cleaning fluid and that level having the highest numerical values of the soil substantivity constant is the maximum. If, for example, the optimum level of cleaning fluid is found to be 40% by weight, the soil substantivity constant would be written as $A_{40\ max.}$. Since the soil substantivity constant does not vary greatly, particularly at high levels of cleaning fluid, it is frequently informative to determine the soil substantivity constant at only one level of cleaning fluid. If, for example, the soil substantivity constant had been determined at only 40% cleaning fluid it would be written as $A_{40}$.

For purposes of definitions based on the soil substantivity constant a cleaning fluid was chosen consisting of 30% Stoddard solvent and 70% water containing sufficient surfactant to lower its surface tension to below 40 dynes per centimeter. The composition of the surfactant is not critical but a mixture of commercial surfactants is preferred which comprises (1) 0.4% of the sodium salt of a mixture of $C_{10}$-$C_{18}$ alcohol sulfates, predominantly $C_{12}$, (2) 0.4% of the diethylcyclohexylamine salt of the same sulfate mix, and (3) 0.2% of the product formed by reacting a mixture of n-octyl mono and diesters of ortho-phosphoric acid with sufficient ethylene oxide to form a neutral product, ordinarily about 2 to 4 mols of ethylene oxide per mol of phosphoric ester.

The cleaning of carpets with small particle cleaning compositions is a dynamic solid-solid equilibrium-controlled adsorption process. Given sufficient time, an equilibrium is reached in the distribution of soil between the carpet and the cleaning particles. Additionally the soil substantivity constant is independent of the soiling level of the carpet. This is indicated by the fact that the same distribution of soil is reached no matter whether the soil is introduced to the system in the carpet or with the cleaning particles. One fruitful effect of these observations is that repeated cleanings are seen to provide increasing soil removal. Fairly complete removal of soil can thus be achieved by repeated cleanings with fresh cleaning composition.

The equilibrium distribution of soil between carpet and cleaning particles is dependent on the nature of the cleaning composition and of the carpet and is independent of the cleaning method used. The rate at which the equilibrium is approached is greatly influenced by the method of cleaning.

The essential features of any carpet cleaning process employing a dry carpet cleaning composition are the contacting of the carpet fibers with the composition, the allowance of a time for contact and transfer of soil, and finally the removal of the soil-saturated composition, usually by a vacuum cleaner. The cleaning efficiency of the composition improves with agitation of the carpet fibers.

The cleaning compositions of this invention have a wide application and can be employed to advantage with conventional applicators and brushes. However, the efficiency of any cleaning operation is necessarily affected both by the cleaning composition employed and by the method with which it is used. When applied by less efficient methods, a cleaning composition may not provide the maximum cleaning power of which it is inherently capable. While all cleaning methods are limited by the cleaning composition employed, they may differ in the speed with which they approach their maximum cleaning result. Excellent results are obtained by use of an oscillating no-torque floor machine which oscillates at 3400 oscillations per minute and rotates at about 40 revolutions per minute, such as Model 91064, commercially available from Holt Manufacturing Company, Malden, Mass.

As will be recognized by those skilled in the art, small amounts of various additives customarily used in carpet cleaning compositions can be added to the present compositions without departing from the concept of this invention. Such additives can be added in a convenient form, such as an emulsion or in solution in the liquid portion of the compositions of this invention. Representative of small amounts of suitable additives would be up to about 1% of optical brightening agents, mildewcides and the like.

In the following examples, which further illustrate this invention, parts and percentages are by weight unless otherwise specified.

EXAMPLE 1

A reaction vessel was charged successively with 333 parts of water, 68.8 parts of urea, 38.1 parts of formaldehyde (as 37% aqueous solution containing about 11% methanol as stabilizer) and 1.07 parts of a surfactant consisting essentially of the reaction product of 10 mols ethylene oxide with 1 mole oleyl alcohol. With the temperature at 23°C. there was added 1 part of HCl as 37% hydrochloric acid. After agitating the mass for 2 hours, the solid product was isolated by filtration and washed with water until the wash water was free of acid. The solid was dried at 120°–125°C. in a vacuum oven. The particles had a compact, cohesive configuration, exhibiting a bulk density of greater than 0.2 g./cc.

A cleaning composition was prepared by mixing 60 parts of these particles having a particle size range between 10 and 80 microns and 40 parts of a liquid emulsion.

The emulsion was prepared by mixing 35 grams of water, 15 grams of odorless Stoddard solvent, 0.2 gram of a commercial surfactant derived from the sodium salt of a mixture of $C_{10}$-$C_{18}$ alcohol sulfates, predominantly $C_{12}$, 0.2 gram of the diethylcyclohexylamine salt of the same sulfate mix, and 0.1 gram of the product formed by reacting a mixture of n-octyl mono and diesters of ortho-phosphoric acid with sufficient ethylene oxide to form a neutral product containing about 2 to 4 mols of ethylene oxide per mol of phosphoric ester.

On testing this composition for carpet cleaning performance, the appearance of the carpet was greatly improved. The soil substantivity constant $A_{40}$ was found to be 6.1.

EXAMPLE 2

The procedure of Example 1 was repeated, except that 60 parts of the urea-formaldehyde polymer particles and 40 parts of a water-containing solution were used. The solution was prepared from 40 grams of water containing 0.4% of a commercial surfactant derived from the sodium salt of a mixture of $C_{10}$-$C_{18}$ alcohol sulfates, predominantly $C_{12}$, 0.4% of a commercial surfactant containing predominantly the diethylcyclohexylamine salt of the same sulfate mix, and 0.2% of a commercial surfactant containing principally the product formed by reacting a mixture of n-octyl mono- and di-esters of orthophosphoric acid with sufficient ethylene oxide to form a neutral product. The soil substantivity constant $A_{40}$ was 3.0.

EXAMPLE 3

The procedure of Example 1 was repeated, except that an agitation period of 1 hour was used, and the ureaformaldehyde particles were prepared from 2.25 parts of urea, 3.375 parts of 37% formaldehyde, 10 parts of water and 0.088 part of 37% hydrochloric acid. Electron photomicrographs showed the particles to have uniform particle size all between 20 and 44 microns (325 to 750 mesh) and the bulk density of the particles was greater than 0.2 g./cc. The cleaning composition prepared from these particles had a soil substantivity constant $A_{40\ max.}$ of 6.7.

EXAMPLES 4–5

The procedure of Example 1 was repeated except that tetrachloroethylene was substituted for the Stoddard solvent in the preparation of the emulsion. Upon testing this composition, the soil substantivity constant, $A_{40\ max.}$, was found to be 3.8.

When the formulation was repeated using methyl chloroform as solvent in preparing the emulsion, testing showed a soil substantivity constant, $A_{40}$, of 4.3.

EXAMPLE 6

The general procedure of Example 1 was repeated, using compact, cohesive urea-formaldehyde particles having a bulk density of 0.3176 grams/cc. and a particle size of 88–105 microns. A cleaning composition was prepared using 60% of these particles; 23.92% water, 12.00% Arco Odorless Solvent, 2.00% $C_8H_{17}C_6H_4$—$(OCH_2CH_2)_5OH$ nonionic surfactant; 2.00% alkyl trimethyl ammonium chloride wherein the alkyl is 93% octadecyl, 6% hexadecyl with 1% miscellaneous impurities (100% A.I.), 0.07% Calcofluor White R.W., and 0.01% Lemon Reodorant. The cleaning composition was evaluated for its soil removal capability according to the procedures outlined herein, using 3 grams of cleaner on the test sample. The use of the cleaning composition resulted in a 74.6% soil removal, corresponding to a soil substantivity value of 2.94, both based on the average of three tests.

This cleaning composition was compared to a control cleaning composition which was identical in all respects, except that the urea-formaldehyde was a crushed foam of the type described in French Pat. No. 2,015,972. The particles, although of the same size of 88-105 microns (−140+170 mesh) exhibited a bulk density of 0.1620 grams/cc. The control cleaning composition exhibited a cleaning effectiveness of 34.0% soil removal and a soil substantivity value of 0.51.

We claim:

1. A powdered cleaning composition having a soil substantivity constant greater than 1.5 and consisting essentially of about 30 to 90% particulate polymeric ureaformaldehyde and about 10 to 70% fluid, the ureaformaldehyde having a particle size of about from 10 to 105 microns, an oil absorption value of no less than 90, fiber hardness and a bulk density of at least 0.2 g./cc., and the fluid consisting essentially of up to 100% water containing sufficient surfactant to give a surface tension of less than 40 dynes per centimeter and up to 100% of organic liquid selected from high boiling hydrocarbon solvents, tetrachloroethylene, methyl chloroform, 1,1,2-trichloro-1,2,2-trifluoroethane, an aliphatic alcohol containing from 1 to 4 carbon atoms, and mixtures of these.

2. A cleaning composition of claim 1 wherein the amount of particulate material is between about 50 and 75% and the amount of fluid is between about 25 and 50%.

3. A cleaning composition of claim 2 wherein the fluid contains about 7 parts water and about 3 parts organic liquid.

4. A cleaning composition of claim 1 further comprising about from 2 to 10% by weight of cationic antistatic agent.

5. A cleaning composition of claim 1 comprising about from 1 to 10% nonionic surfactant and about from 1 to 4% cationic surfactant.

* * * * *

UNITED STATES PATENT AND TRADEMARK OFFICE

CERTIFICATE OF CORRECTION

PATENT NO. : 4,013,594

DATED : March 22, 1977

INVENTOR(S) : Helmut Hermann FROEHLICH et al

It is certified that error appears in the above-identified patent and that said Letters Patent are hereby corrected as shown below:

Column 1, line 57, after "these." add:

--The expression "fiber hardness" referred to earlier in this paragraph, as indicated in the earlier applications of this series, means: a hardness of less than about 3.2 on the Moh scale, less than about 130 on the Rockwell M scale, and more than about 30 on the Shore A scale. In the case of the urea-formaldehyde particles employed in the present invention, the relevant data, taken from Sasso, Plastics for Industrial Use, 1st Edition, McGraw-Hill Book Co., Inc., New York and London, 1942, are as follows: Sp.Gr., 1.45-1.50; Hardness Rockwell M, 110-130; or Moh 3.--

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*